United States Patent [19]

Fuchs

[11] Patent Number: 4,934,933

[45] Date of Patent: Jun. 19, 1990

[54] DENTAL WORK STATION

[76] Inventor: Jack Fuchs, 2607 Aylesbury Ct., Louisville, Ky. 40242

[21] Appl. No.: 312,468

[22] Filed: Feb. 21, 1989

[51] Int. Cl.[5] ..... A61G 15/14

[52] U.S. Cl. ..... 433/79; 312/209

[58] Field of Search ..... 433/77, 79, 98; 312/209; 108/149

[56] References Cited

U.S. PATENT DOCUMENTS

| | | | |
|---|---|---|---|
| 3,821,852 | 7/1974 | Kato | 433/79 |
| 4,013,328 | 3/1977 | Wolf et al. | 433/79 |
| 4,443,194 | 4/1984 | Fuchs | 433/79 |

FOREIGN PATENT DOCUMENTS

| | | | |
|---|---|---|---|
| 1491063 | 5/1969 | Fed. Rep. of Germany | 433/77 |
| 2530478 | 5/1977 | Fed. Rep. of Germany | 433/77 |

*Primary Examiner*—Cary E. Stone

*Attorney, Agent, or Firm*—Scott R. Cox

[57] ABSTRACT

A dental work station designed to position the dental assistant's instrumentation and the dentist's dynamic instrumentation in an efficient location to deliver dental instruments to the respective operators in the best position in relation to the patient for both the comfort of the patient and the ease of the operators is shown. Due to the unique design of the work station, the instrumentation of both the assistant and the operator can switch from a left-handed to right-handed and reverse itself in a matter of seconds, thus making it a completely ambidextrous unit. The unique arrangement of the overhead structure allows the dentist's dynamic instruments to be efficiently delivered to the dentist without interfering with the dental assistant's equipment. In addition, the overhead structure houses both the astral operating light and the general light fixtures to provide optimum lighting for the operators. The overhead structure also contains a plurality of pipe chases to deliver essential dental utilities from the utility junction box located in the base of the service cabinet to the dentist's instruments. As added equipment there may also be provided a television monitor, a video cassette recorder and a computer for use during the operation of the dentist. This work station with all of its features leaves the dentist's chair completely unencumbered with great allowances for any type of operating position, thus making it a completely self contained dental operating unit.

12 Claims, 8 Drawing Sheets

DENTAL WORK STATION

BACKGROUND OF INVENTION

1. Field of Invention

This invention relates to dental equipment. In particular, this invention relates to a dental work station comprised of a dentist dynamic instrument service cabinet with an attached structure and a dentist's dynamic instrument station attached to the end of the overhead structure which is located forward of the patient's chair.

2. Prior Art

For many years efforts have been made to develop a comprehensive dental work station which will provide easy access for the dentist to the dentist's dynamic instruments, provide access for the dentist's assistant to the assistant's instruments, supply adequate lighting to the operating theatre and at the same time be easily convertible for use by a left-handed or a right-handed dentist. Efforts have been made to design dental systems which position the dental assistant's instruments and the dentist's dynamic instruments in a reasonable position in relation to the patient's oral cavity. While many of these dental systems have been partially useful, certain problems remain and new ones have been created because of the automation in the dental practice.

For example, Canadian Patent No. 877,196 discloses a dental operatory wherein both the dentist's and the dental assistant's equipment are housed in a cabinet which is located behind the head of the patient's chair. The operatory is not easily convertible for use by a right-handed and a left-handed dentist since all the dentist's dynamic instruments and equipment are located on one side of the cabinet while the dentist assistant's instruments and equipment are located on the opposite side of the cabinet. Other disadvantages to this dental operatory include a lack of easily adjustable lightening, inconvenient access to the dentist's equipment and many other deficiencies present because the design does not anticipate the modern advances in dental procedure.

British Patent No. 1,138,294 provides a less static work station by placing the dynamic instruments in a moveable dental unit. However, this work station still is not easily adaptable for use by both a right-handed and a left-handed dentist. Further, it fails to provide for the activities of a dental assistant and continues many of the same problems that exist in the '196 patent because it fails to anticipate the modern dental work procedure.

U.S. Pat. No. 4,443,194 discloses a dental operating unit with a reversible dental assistant's unit. This patent provides a dental operating unit associated with a dentist's dynamic instrument service cabinet to allow for reversing of the dental assistant's work station from the left side to the right side of the patient's chair. The dentist's dynamic instruments are maintained in a central location attached to the front of the service cabinet. While this unit provides more flexibility than previously designed dental operating units, it fails to place the dentist's dynamic instruments in the most efficient location for use, that is, in front of the patient. In addition, the design does not provide for other modern non-dental accessories to be utilized in conjunction with the dentist's equipment, such as a computer or visual/aid equipment and, in addition, fails to provide adequate lighting for the dental operating theatre.

U.S. Pat. No. 4,249,900 discloses a dental console wherein two support arms are rotatably mounted on a common pedestal which is located in front of the patient's chair. Each of these arms is comprised of a group of segments which rotate from the common pedestal to allow for positioning on either the right side or the left side of the patient's chair. While this console does provide a means for access to the dentist's equipment whether the dentist is left-handed or right-handed, it has several significant flaws. The rotatable arms are quite long and require three or four different segments for full extension, thus necessitating heavy, expensive apparatus. In addition, the heavy weight of the equipment at the end of the arms puts great strain on the support portions of the apparatus. Further, by placing the dental console in front of the patient's chair, access to water, air, etc. must be provided in two different locations, one in front of the patient's chair within the dental console and one behind the chair where all of the remaining dentist's equipment, supplies and utensils are stored. This arrangement is inconvenient and may be impossible in some dentist's facilities.

Additional extendable arm patents associated with a dentist's operation include, for example, U.S. Pat. Nos. 4,610,630, 4,427,382, 4,126,939, 4,114,274, 3,821,852 and 3,805,388. While each of these patents provides a slightly different method of presenting the instruments to the dentist, each has significant defects. Each arm is connected to or associated with the patient's chair, which creates problems with usage for right-handed or left-handed dentists. By having the arm project on one side of the dentist's chair, it interferes with the operation of either the dentist or the dental assistant. In addition, none of these patents provides the wide range of operation as is present with the current invention.

Therefore, it is an object of this invention to provide a dental work station designed to position the dental assistant's instruments and the dentist's dynamic instruments in the most convenient location in relation to the patient's mouth.

It is another object of this invention to provide a dental work station wherein the connections for power, water, vacuum and other dental utilities are conveniently positioned to reduce the external umbilicals which are normally associated with the dental operatory.

It is a still further object of this invention to provide a dental work station with an overhead structure to position the dental equipment in the best possible position for the dentist, that is raised up above the floor and directly in front of the patient's chair.

It is a still further object of the invention to provide a dental work station where the patient's chair will not interfere with the operation of the dental work station.

It is a still further object of this invention to provide a dental work station with well situated lighting both in the overhead structure and in the astral lamp.

It is a still further object of this invention to provide a shelf unit which is associated with an overhead structure which can support a television and video cassette recorder for optimum use by the dentist and/or patient during the dental procedure.

These and other objects and features of the present invention will be apparent to those skilled in the art from a consideration of the following detailed description, drawings and claims. The description along with the accompanying drawings provides a selected example of the construction of the device to illustrate the invention.

SUMMARY OF INVENTION

In accordance with the present invention, there is provided a dental work station comprising:

(a) a dentist's dynamic instrument service cabinet containing access for essential dental utilities;

(b) a reversible dental assistant's instrument station connected to the cabinet by a first pivoting bracket arm wherein said first pivoting bracket arm will pivot in a horizontal plane between the left and right side of the head of a patient's chair;

(c) a generally J-shaped overhead structure secured to the service cabinet which wraps over and around the patient's chair and which contains a pipe chase for conveying essential dental utilities through the overhead structure, a lighting means to project light down from the overhead structure and an astral lamp secured by a securing means to the overhead structure; and (d) dentist's dynamic instrument station secured to the end of the overhead structure by a second pivoting bracket arm, whereby said second pivoting bracket arm will swing in a horizontal plane between the left side and right side of the patient's chair for use by the dentist from either side of the patient's chair.

This invention will provide a comprehensive dental work station designed to position the dental assistant's instruments and the dentist's dynamic instruments in relation to the respective operators in the best position relative to the patient's mouth for both the comfort of the patient and for ease of operation of the operators. Due to the unique design of this work station, the instruments of both the dental assistant and the dentist can switch from the left to right side of the patient's chair in a matter of seconds to make it a completely ambidextrous unit. The overhead structure allows the dentist's dynamic instruments to be delivered from an arm with a pivot point located just above and in the center of the patient's knees, providing the best possible travel distance for the instruments to the dentist's fingertips as the dentist is comfortably seated on either side of the patient's chair.

The overhead structure houses the dental operating light and the general vision light fixtures to give the dental team optimum lighting of the patient's mouth. The overhead structure also encloses a pipe chase for delivery of the essential dental utilities to the dentist's dynamic instrument station from one utility junction box located in the base of the service cabinet. This overhead structure also contains a shelf to set a computer monitor or television set at the optimum viewing position for the patient, dentist or dental assistant.

The service cabinet section of the dental work station, located in the rear of the patient's chair, can deliver all other essential dental operating equipment and other dental material not contained on the dentist's dynamic instrument station to the operators.

This dental work station with all of its features, leaves the dentist's work area completely free and unencumbered and permits the patient's chair to be adjusted to any and all operating positions without interfering with the dental work station thus, providing the first truly self-contained dental work station.

BRIEF DESCRIPTION OF THE DRAWINGS

The invention will now be described with reference to the accompanying drawings in which.

DETAILED DESCRIPTION OF THE PREFERRED EMBODIMENT

Figure 1:
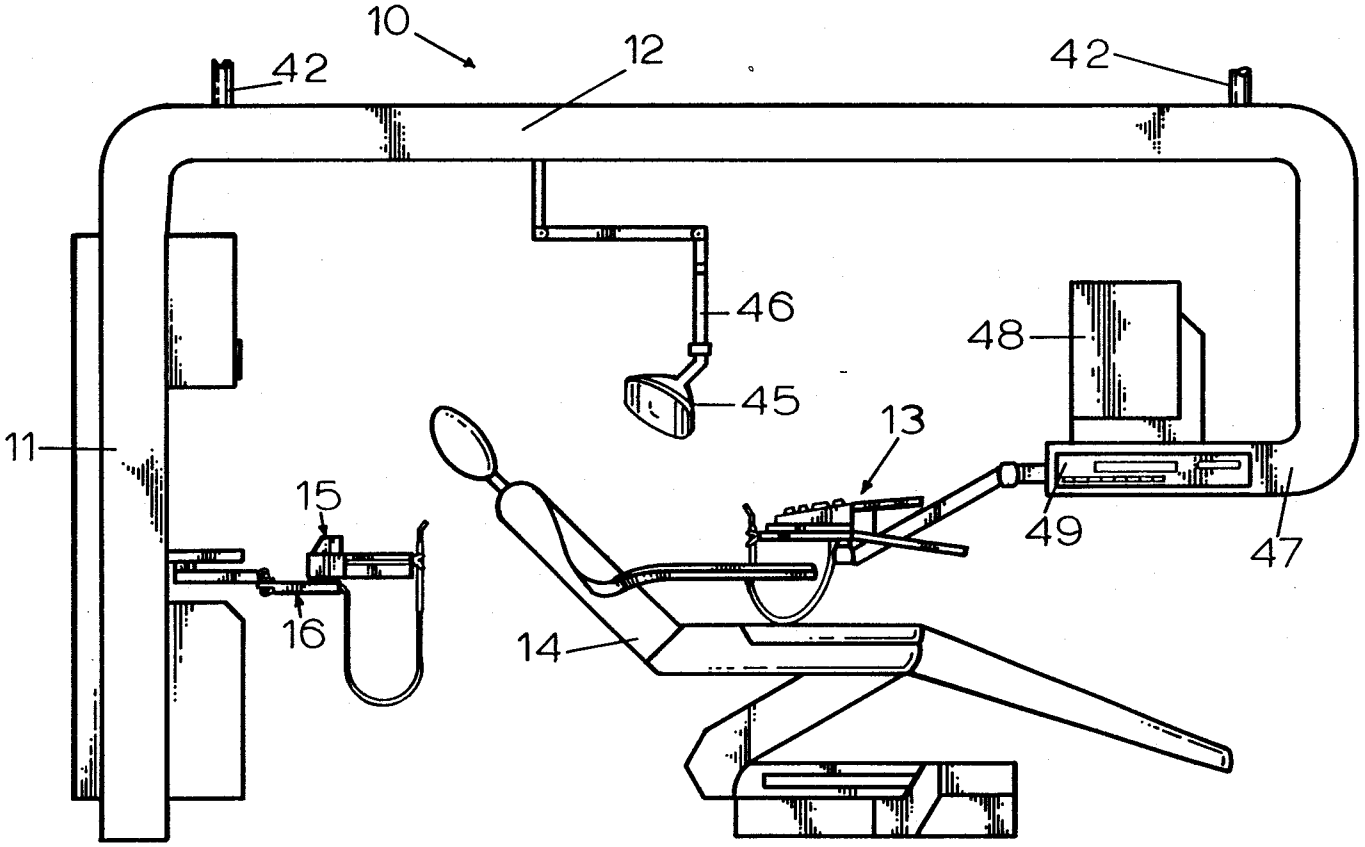
FIG. 1 is a side view of the dental work station.

Although the invention is adaptable to a wide variety of uses, it is shown in the drawings for purpose of illustration as embodied in a dental work station, (10) comprised of dentist's service cabinet, (11) a generally J-shaped overhead structure (12) and a dentist's dynamic instrument station (13). See FIG. 1. It is understood that there are many arrangements of the equipment and devices disclosed in this invention and the accompanying description is merely one example of that arrangement.

Figure 2:
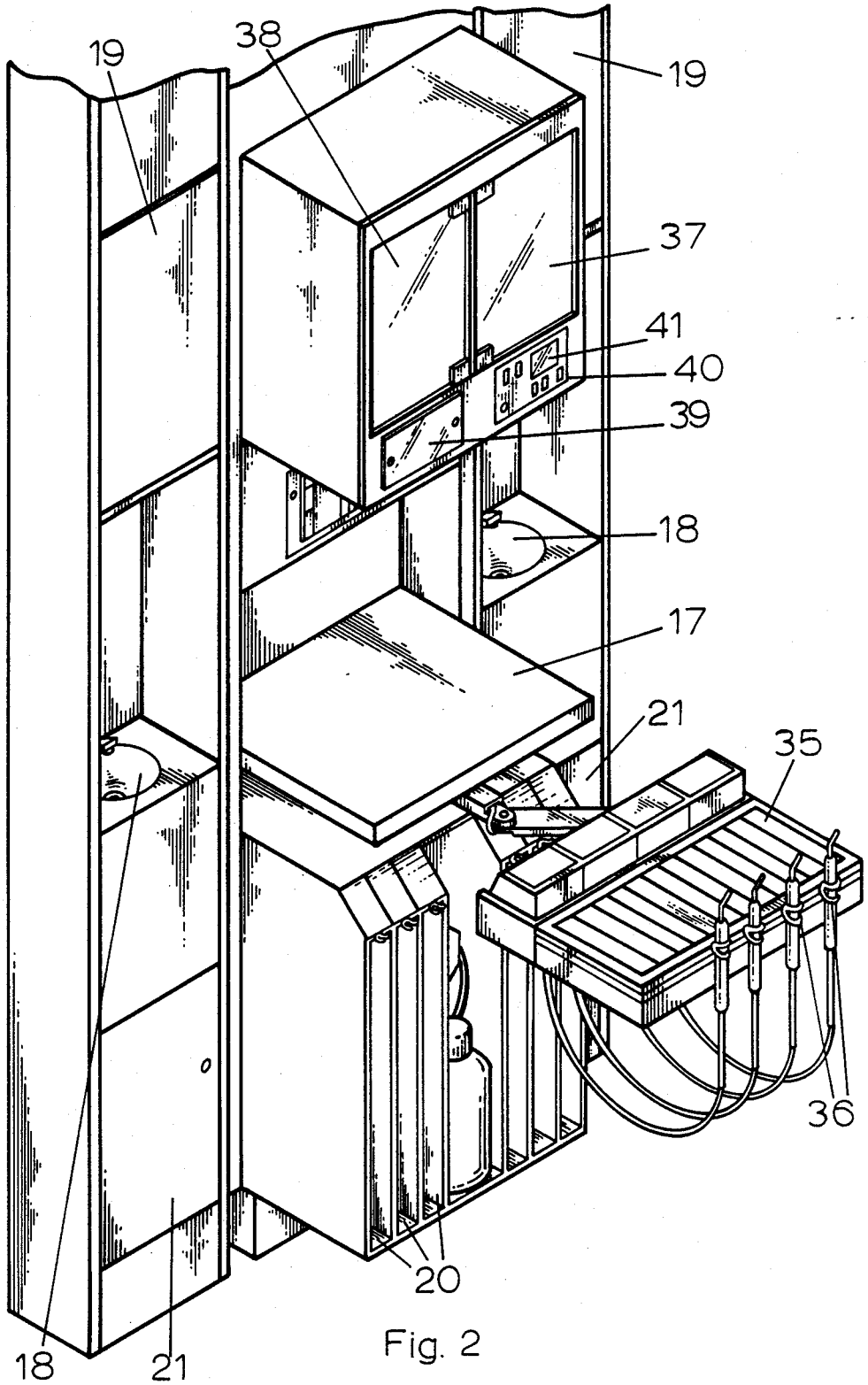
FIG. 2 is a side perspective view of the dentist's service cabinet.

The dentist's service cabinet (11) is a rear delivery system for use by the dentist or dental assistant adjacent to the head of the patient's chair (14). The service cabinet provides access to the junction box of essential dental utilities. Secured thereto is a reversible dental assistant's unit (15) which is connected to the cabinet by a first pivoting bracket arm (16). See FIG. 2. The service cabinet contains a counter top (17) which can extend on both the right hand and left hand side of the service cabinet. Each side of the service cabinet is furnished with a sink (18) and a sink cabinet (19) with each sink cabinet located above the counter top which is easily assessable to both the dentist and the dental assistant. This is an optional feature which may or may not be provided depending upon the preference of the operator.

The bottom portion of the service cabinet contains a series of storage compartments (20) and access doors (21) for access to the dental utilities. Running through the service cabinet are the hoses or tubes for the typical dental utilities, such as vacuum, water, compressed air, electricity for providing power to the various electrical instruments and various gas tubes for providing gases such as nitrous oxide for use during dental procedures. In an alternative embodiment the service cabinet can be hung from a back wall rather than being supported by the floor but in either embodiment the utility lines will run through the cabinet.

Figure 3:
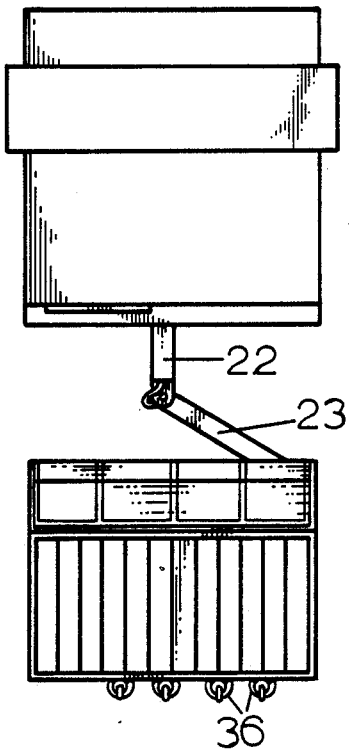
FIG. 3 is a top view of the dentist's service cabinet.
Figure 4:
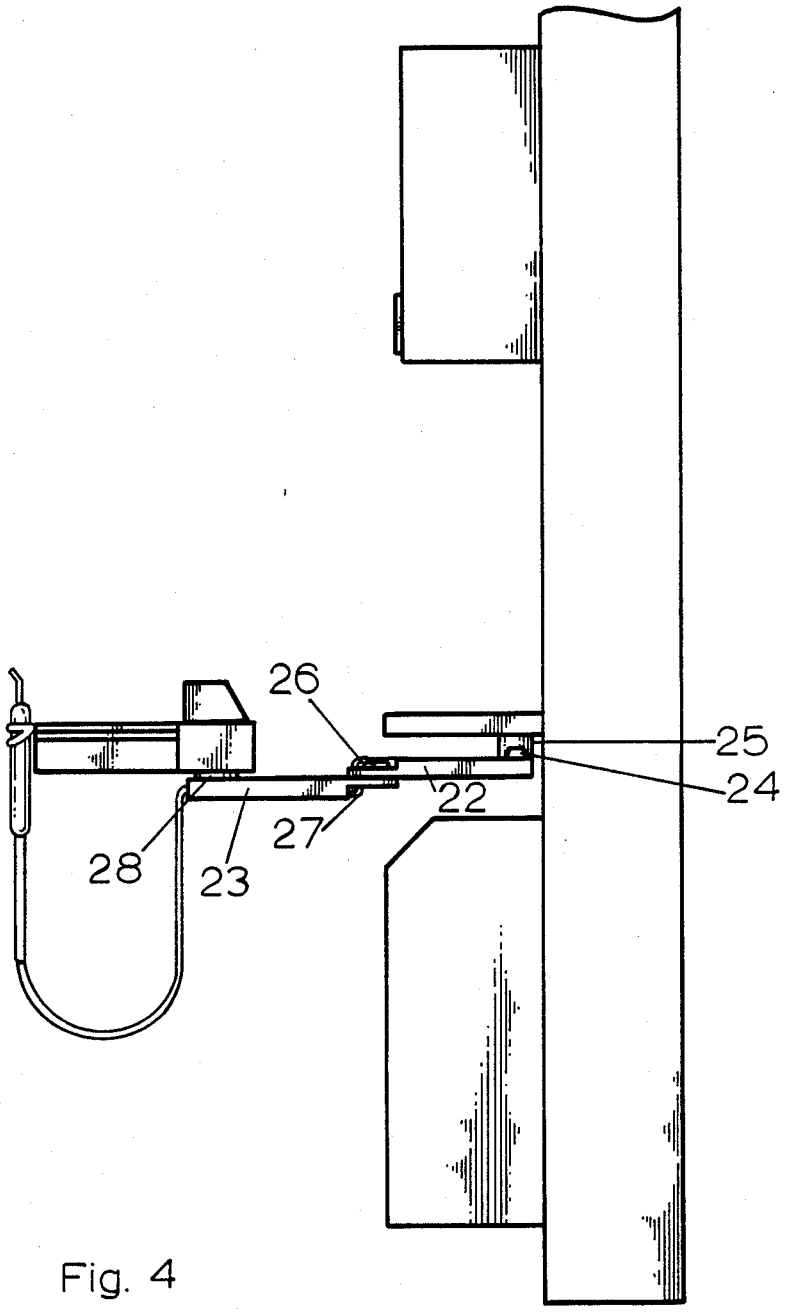
FIG. 4 is a side view of the dentist service cabinet.
Figure 7:
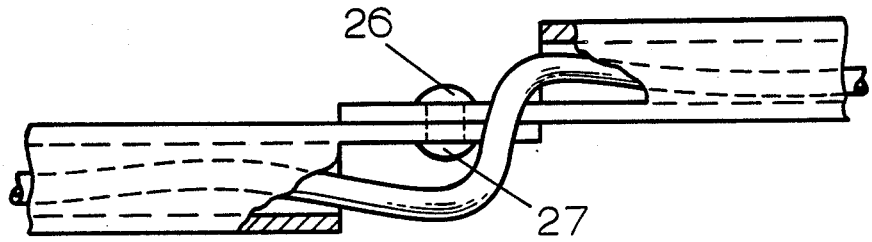
FIG. 7 is a side cut away view of the first pivoting bracket arm for holding the dental assistant's equipment.

As previously stated there is secured to the body of the service cabinet a first pivoting bracket arm (16) which holds the dental assistant's equipment. In a preferred embodiment, the first pivoting bracket arm is comprised of a first (22) and second (23) pivot connection segments. See FIG. 3. As is best seen in FIG. 4, the first pivot connection section has an anchor pivot (24) at one end for coupling with a heavy-duty bracket member (25) that is supported either on the top of the service cabinet or on the underside of the counter top of the service cabinet. The opposite end of the first pivoting connection segment is provided with a pivot pin (26) for cooperation with a mating end (27) of the second pivoting connection segment (23) so as to establish a pivotal connection between the two pivoting connection segments. See FIG. 7. The opposite end of the second pivoting connection segment has a pivot bearing (28) for connection to the rear portion of the dental assistant's unit so that this unit is pivotally suspended from the first bracket arm. The pivoting nature of the pivoting connection segments can be best understood by studying FIGS. 3 and 4. These pivoting connection segments are of shallow, vertical dimensions so that they may fit into the gap between the underside of the counter top and the top of the service cabinet as is shown in FIG. 4.

Figure 5:
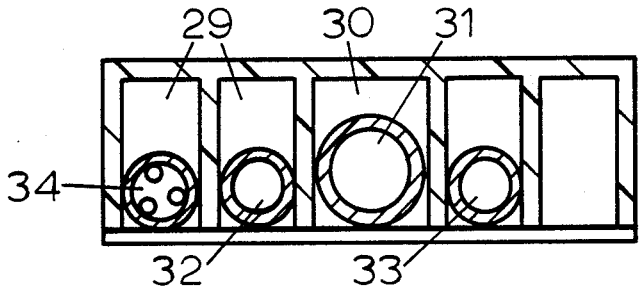
FIG. 5 is a cross section view of the first pivoting bracket arm.

A bottom view of the first pivoting bracket arm (16) would show a series of open parallel channels (29) as shown in FIG. 5. A central channel (30) is wider than the other channels because it accommodates the vacuum hose (31). Other hoses contained within these parallel channels may be a water nose (32) for the water syringe, a compressed air hose (33) for the compressed air syringe and an electrical cable (34) to provide power for any electric instruments. Extra lengths of the hose and cable should be furnished near the central pivot means between the two pivoting connection segments so that the segments may pivot relative to each other. The dental assistant's unit also contains a tray (35) and other conventional dental assistant's equipment which is placed on or adjacent to the dental assistant's tray. Secured to the front of the dental assistant's unit are clamp members (36) for holding the dental assistant's instruments when not in use.

Optionally, there is provided on the upper portion of the service cabinet a series of eye-level cabinets (37, 38) to provide for storage of supplies, instruments, patient's records, etc. There may also be provided on the front of the service cabinet a number of useful dental accessories, including an X-ray viewer (39), a flow meter control (40) for the gases contained within the service space and a timer (41) for use with many of the dental operations. See FIG. 2.

Secured to the top of the service cabinet is a generally rectangular on a cross-section support structure which is an integral part of the generally J-shaped overhead structure (12). The overhead structure is generally hollow and rectangular on a cross-section, support structure. See FIG. 1. This overhead structure runs from the service cabinet over the patient's chair and archs down and back towards the patient's chair in front of the patient's chair to form the generally J-shaped structure. This structure may be formed from any strong, durable, relatively low weight material such as wood, steel or heavy duty aluminum. For appearance it may be covered with FORMICA TM or wood vernier.

Since this overhead structure will project out from the service cabinet, it will need some form of bracing. In one preferred embodiment the overhead structure is supported by a pair of rod ceiling supports (42) running from the top of the overhead structure to the ceiling. See FIG. 1. These rod ceiling supports are secured by conventional securing means, such as screws, bolts and other fasteners to both the ceiling and the overhead structure. In situations where a ceiling support is not feasible because of the height of the ceiling, a pair of supporting front legs may be secured to the lower portion of the shorter, bottom arm of the J of the overhead structure to the floor thus supporting the weight of the overhead structure. (not shown).

Figure 10:
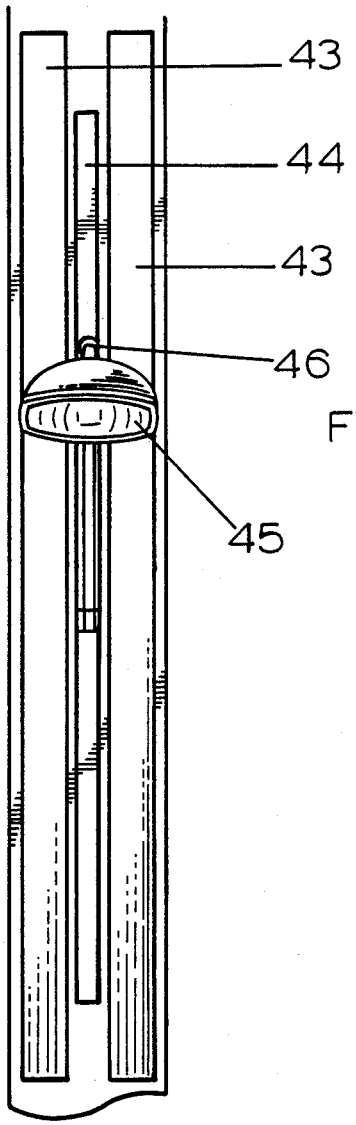
FIG. 10 is a bottom view of the overhead support structure.

Contained within the overhead structure are a plurality of lighting fixtures, preferably a pair of fluorescent light fixtures (43). See FIG. 10. These lighting fixtures provide the general lighting for the operating theatre. Running most of the length of the bottom portion of the overhead structure is a track lighting system (44), which is used with an astral lamp (45) to provide lighting for the mouth of the patient. It is attached to the overhead structure by a conventional attachment arm (46) which provides for movement and choice of location in the operating theatre.

In addition to the lighting the overhead structure will house a conventional pipe chase or a group of pipe chases for the tubing or wires for water, air, electricity and other utilities necessary for the dentist's practice. For safety purposes the water hose will be separated from the electricity line and run in a separate pipe chase (not shown).

On the shorter, bottom arm of the overhead structure there is provided a shelf (47). This shelf can hold a television (48) or other visual displays for easy access and viewing by the patient and the dentist. Optionally provided on the side of shorter bottom arm of the overhead structure, adjacent to the television is an opening with electrical connection for a video cassette recorder (49) which is wired to the television for the showing of informational dental programming or entertainment for the patient.

Figure 6:
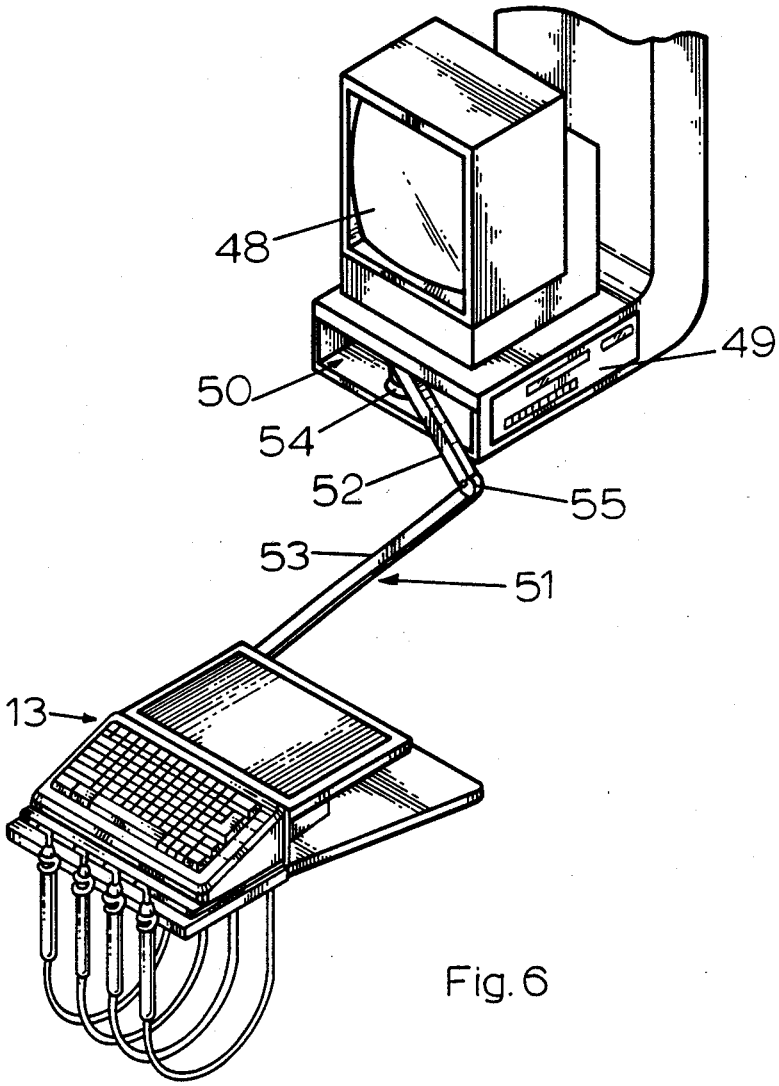
FIG. 6 is a side perspective view of the dentist's dynamic instrument station secured to the overhead structure.

The end of the shorter bottom arm of the overhead structure is provided with an opening 50 . Attached on the inside bottom surface of this opening is a second pivoting bracket arm (51), which holds at its end the dentist's dynamic instrument station (13). See FIG. 6. The second pivoting bracket arm is a conventional dentist's equipment arm for dental equipment which provides easy accessibility and movement of the dentist's dynamic instruments to the dentist. In a preferred embodiment the second pivoting bracket arm is comprised of pair of pivoting arm segments (52, 53). The first pivoting arm segment (52) has an anchor pivot (54 at one end for coupling with a heavy duty bracket member which is supported within the opening (50) in the arm of the overhead structure. The opposite end of the first pivoting arm segment is provided with a rotational joint (55) to provide for great flexibility in the movement of the pivoting arm segments.

The second pivoting arm segment (53) is similar in construction to the first pivoting arm segment. On the second end of the second pivoting arm segment is provided second pivoting arm joint not shown) for connection to the dentist's dynamic instrument station of similar construction to the anchor pivot (54). Again this is a conventional joint bearing for providing free rotation of the dentist's dynamic instrument station. Any one of the conventional arms used for securing a dentist's instrument station to a brace is acceptable as a second pivoting arm in this invention.

Figure 8:
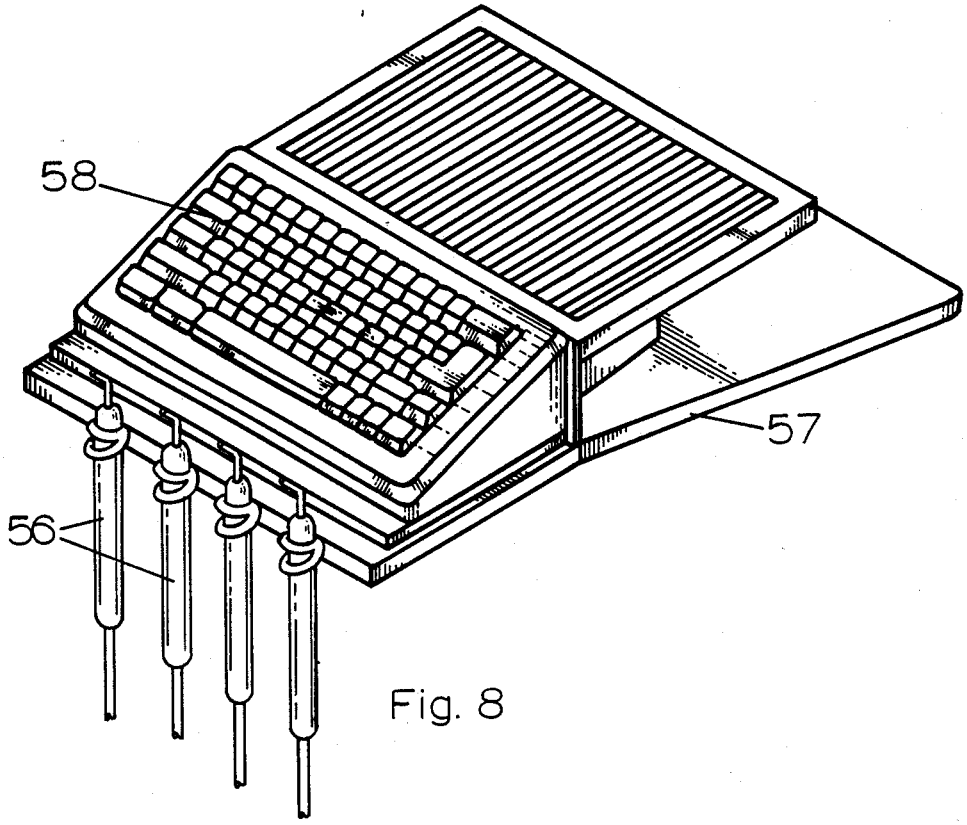
FIG. 8 is a side perspective view of the dentist's dynamic instrument station.
Figure 9:
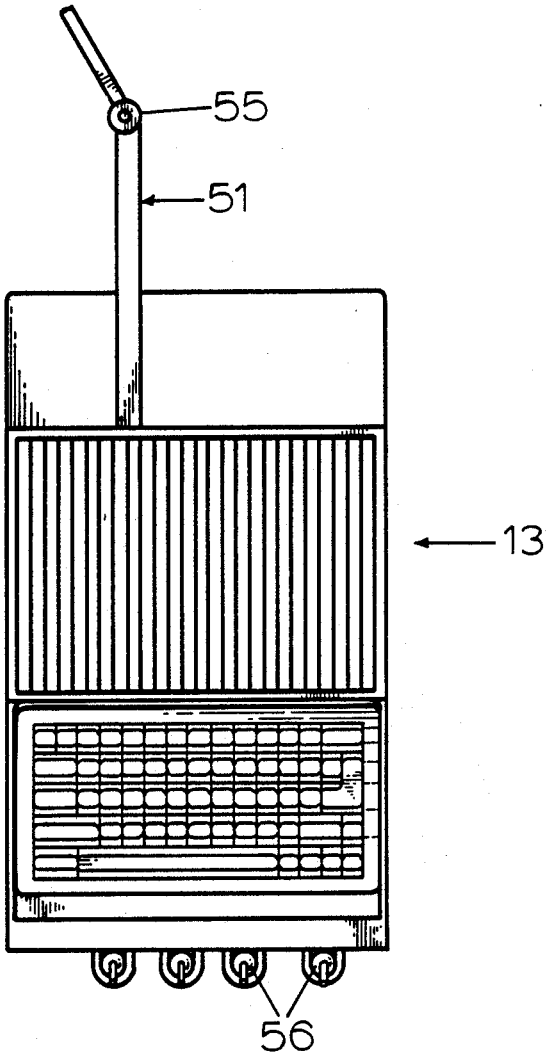
FIG. 9 is a top view of the dentist's dynamic work station.

The dentist's dynamic instrument station (13) is conventional and is furnished with the usual dynamic instruments (56) that may vary depending upon the nature of the practice of the dentist. See FIGS. 8 and 9. Among the commonly used instruments are a Cavitron, a high speed drill, a low speed mini drill, a low speed drill, a high speed drill and an electrosurg. Other conventional instruments are well known to those in the industry.

The utility lines for the operation of these instrument will flow through the pivoting arm segments or the second pivoting bracket arm from the utility lines running through the overhead structure. The lines will run through the pivoting arm segments in a similar manner to that in the first pivoting arm.

The dentist's dynamic instrument station also contains a conventional dentist's shelf (57) for holding the dentist's equipment and operating utensils. In a preferred embodiment, there is associated with the dentist's instrument station a computer keyboard (58) which will be connected to the television screen to provide for computer usage by the dentist during the dental operation.

Since both the dental assistant's unit and the dentist's dynamic instrument station are freely rotatable, they provide easy access to all the dental instruments and the patient for both a left-handed and the right-handed dentist. Further, because of the easy rotation of the assistant's unit and the dentist's dynamic instrument station, the change over time from a left-handed to a right-handed dentist is a matter of seconds.

In operation, the dental work station (10) can be organized for use by either a left-handed or a right-handed dentist. If a right-handed dentist is using the work station, the dentist's dynamic instrument station (13) is rotated so that it is to the right side of the patient's chair (14) and approximately the same distance from the dentist as is the patient. The dentist assistant's unit (15) is then rotated to the left side of the patient's chair for easy access by the dental assistant. If the next dentist to use the work station is left-handed, rotation of both of these units is quite easy and set up time is a matter of seconds. In addition, by the location of the dentist's dynamic instrument station, both the dentist and the dental assistant along with their instrumentation are positioned to deliver the instruments to the respective dentist or assistant in the best position in relation to the patient for both the comfort of the patient and the ease of the operation. In addition, the self-contained lighting features of the invention provide a better view of the operating theatre than in conventional dental work stations.

What is claimed:

1. A dental work station for use with dentist's equipment comprising:

a. a dentist's dynamic instrument service cabinet containing access for essential dental utilities;

b. a reversible dental assistant's instrument station connected to the cabinet by a first pivoting bracket arm wherein said first pivoting bracket arm will pivot in a horizontal plane between the left and right side of the head of a patient's chair;

c. a generally J-shaped overhead structure secured to the service cabinet which runs over and around the patient's chair, wherein said overhead structure is comprised of an upper arm which contains a plurality of pipe chases for conveying essential dental utilities through the overhead structure to the dentist's equipment, a bottom arm, a lighting means to project light down form the overhead structure, an astral lamp secured by a securing means to the overhead structure and a shelf; and d. a dentist's dynamic instrument station secured to the end of the J-shaped overhead structure by a second pivoting bracket arm, whereby said second pivoting bracket arm will swing in a horizontal plane between the left side and the right side of the patient's chair for use by the dentist from either side of the patient's chair.

2. The dental work station of claim 1 wherein there is provided on the lower portion of J-shaped overhead structure a shelf.

3. The dental work station of claim 1 wherein the end of the J-shaped overhead structure away from the service cabinet contains electrical outlets and attachment means for a television.

4. The dental work station of claim 1 wherein the end of the J-shaped overhead structure away from the service cabinet contains electrical outlets and attachment means for a video cassette recorder.

5. The dental work station of claim 1 wherein the dentist's dynamic instrument station has attachment means for attaching a computer keyboard to function in communication with a television located on the shelf of the overhead structure.

6. The dental work station of claim 1 wherein the astral lamp is secured to the overhead structure by track lighting.

7. The dental work station of claim 1 wherein the overhead structure contains a pipe chase for transferring essential dental utility lines from the service cabinet to the end of the overhead structure.

8. The dental work station of claim 1 wherein the dentist's dynamic instrument service cabinet is furnished with a counter top, a sink, a series of storage compartments and access doors and one end of the first pivoting bracket arm.

9. The dental work station of claim 1 wherein the overhead structure is formed from any strong durable, relatively low weight material selected from the group consisting of wood, steel or heavy-duty aluminum.

10. The dental work station of claim 9 wherein the overhead structure is selected from the group consisting of FORMICA TM or wood vernier.

11. The dental work station of claim 1 wherein the overhead structure is supported by a pair of rod ceiling supports running from the top of the overhead structure to the ceiling.

12. The dental work station of claim 1 wherein there is attached to the inside bottom surface of an opening in the bottom arm of the overhead structure is a second pivoting bracket arm which holds at the end of said second pivoting arm a dentist's dynamic instrument station.

* * * * *